United States Patent [19]

Seilly et al.

[11] 4,269,388

[45] May 26, 1981

[54] VALVE OPERATING MECHANISM

[75] Inventors: Alec H. Seilly, North Wembley; Rasmus J. Sonderskov, Pinner, both of England

[73] Assignee: Lucas Industries Limited, Birmingham, England

[21] Appl. No.: 868,489

[22] Filed: Jan. 11, 1978

[30] Foreign Application Priority Data

Jan. 12, 1977 [GB] United Kingdom ..... 1085/77

[51] Int. Cl.[3] ..... F16K 31/10

[52] U.S. Cl. ..... 251/138; 251/77; 123/90.11; 123/90.47

[58] Field of Search ..... 251/138, 77; 123/90.11, 123/90.47

[56] References Cited

U.S. PATENT DOCUMENTS

| | | | |
|---|---|---|---|
| 1,259,371 | 3/1918 | Davis | 251/138 X |
| 1,735,511 | 11/1929 | Shrode | 251/138 |
| 1,799,927 | 4/1931 | Palm | 123/90.11 |
| 2,052,246 | 8/1936 | Ray | 251/138 |
| 2,225,265 | 12/1940 | Fitts | 123/90.47 |
| 2,930,249 | 3/1960 | London et al. | 251/77 X |
| 3,024,775 | 3/1962 | Wuest | 123/90.47 |
| 3,064,635 | 11/1962 | Rohrbacher | 123/90.47 X |
| 3,548,793 | 12/1970 | Richardson | 123/90.11 X |
| 3,799,498 | 3/1974 | Wickham et al. | 251/77 X |

*Primary Examiner*—Arnold Rosenthal

[57] ABSTRACT

An engine poppet valve operating mechanism comprises a pivotal link which is positioned in use to engage the stem of the valve to be operated. An electro magnetic device has a winding which electric current can be supplied when it is required to open the valve. An output member forms part of the device and interposed between the output member and the link is energy storing means. The arrangement is such that when the device is energized the output member will move to an extended position and the movement of the link and valve will be at least partly effected by energy stored in the means during movement of the output member to the extended position.

4 Claims, 3 Drawing Figures

VALVE OPERATING MECHANISM

This invention relates to engine poppet valve operating mechanism and has for its object to provide such a mechanism in a simple and convenient form.

According to the invention an engine poppet valve operating mechanism comprises in combination, a pivotal link, said link being positioned in use, to engage the stem of the valve to be operated, an electromagnetic device having a winding to which electric current can be supplied when in use it is required to open the associated valve, an output member forming part of said device and which is moved to an extended position when said winding is energised, and energy storing means positioned between said output member and said link, the arrangement being such that in use, when said winding is energised said output member will move to said extended position, the movement of the link and valve being at least partly effected by energy stored in said means during movement of said output member to the extended position.

According to a further feature of the invention said energy storing means comprises a spring.

Three examples of valve operating mechanism in accordance with the invention will now be described with reference to the accompanying drawings the three Figures of which show the examples respectively in sectional side elevation.

Figure 1:
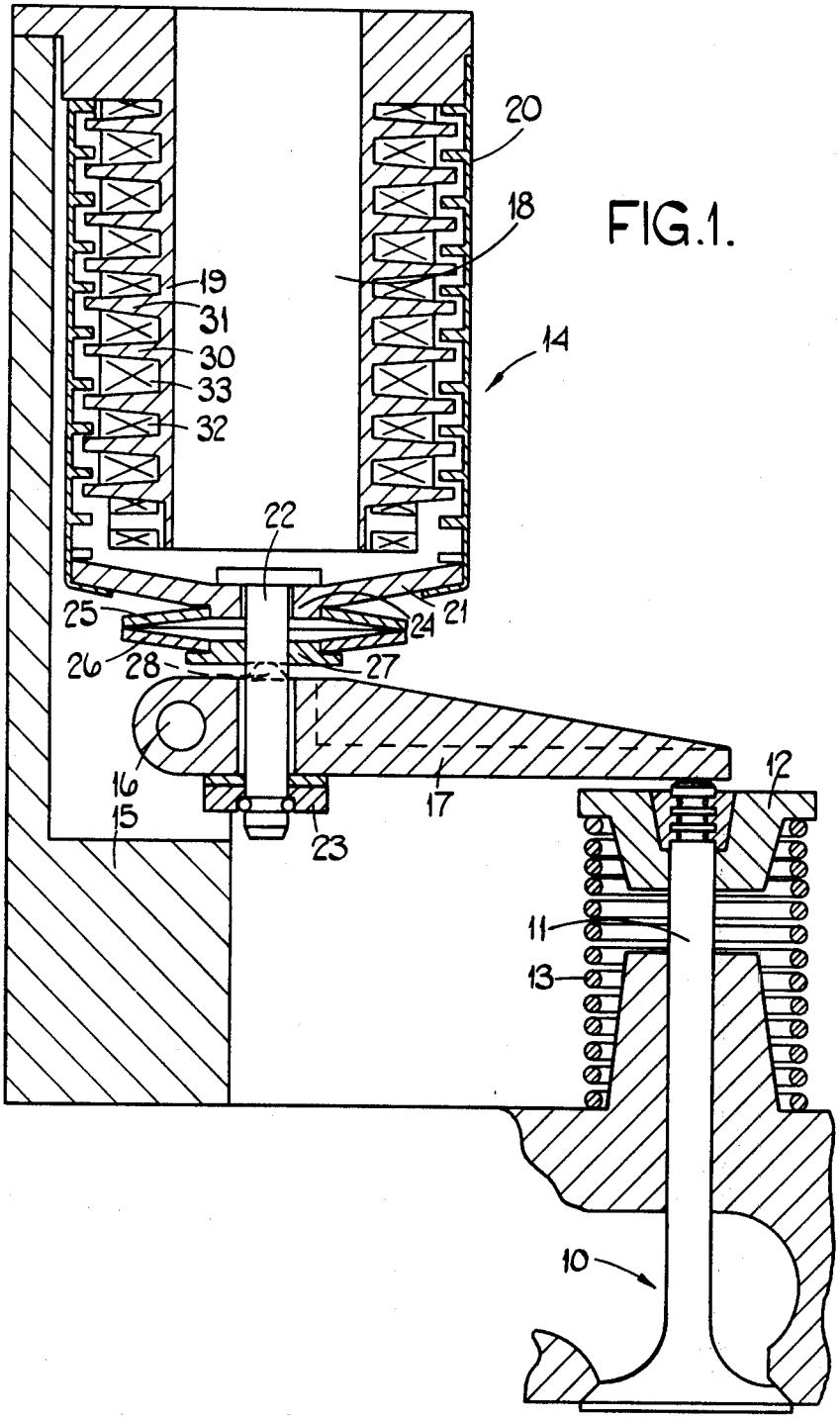
FIG. 1 illustrates one form of the invention.

Referring to FIG. 1 of the drawings the engine valve is indicated at 10, the stem 11 of the valve projecting in the usual manner from the guide bore in which it is located. The head of the stem mounts a pair of split collets utilised to retain a spring abutment 12 in position on the stem. Interposed between the abutment 12 and the portion of the engine carrying the valve, is a coiled compression spring 13.

Generally indicated at 14 is a valve operating mechanism which includes a support portion 15 adapted to be secured or forming part of the structure of the engine of which the valve forms part. The support portion 15 carries a pivot pin 16 which mounts a link 17 for pivotal movement. The end of the link 17 remote from the pivot is positioned to engage with the end of the stem of the valve, a small clearance being provided between the link and the end of the valve when the valve is in the closed position.

The mechanism 14 includes an electromagnetic device 18 which includes an inner annular member 19 secured to the support portion 15 and a movable outer annular member 20. The outer annular member 20 extends beyond the inner member at its end adjacent the link and mounts an end closure 21 constituting the output member of the device. Formed in the end closure 21 is an aperture and extending through the aperture is a headed pin 22 which also extends through a bore formed in the link 17. At its free end the pin 22 is provided with a washer 23 this being retained on the pin by means of a circlip. Conveniently the pin passes with clearance through the aperture formed in the link so as to permit pivotal movement of the link as will be described.

The output member defines a boss 24 about which is located a resilient dished washer 25 the outer periphery of which engages the outer periphery of a further dished washer 26. The concave faces of the two washers are presented to each other and the inner periphery of the washer 26 is engaged about a pressure pad 27 slidable upon the pin and engaging on opposite sides of the pin 22, upstanding rounded projections 28. The thickness of the washer 23 is chosen so that no clearance exists between the pressure pad and the projections and preferably the resilient washers are compressed slightly. The projections allow pivotal movement between the pressure pad 27 and the link 17.

The inner annular member 19 is provided on its outer peripheral surface, with a two-start helical thread form which defines two helical ribs 30, 31. Intermediate the ribs is defined a groove and as a result there are a pair of helical grooves in which are located windings 32,33. The direction of current flow in the windings 32 is opposite to that in the windings 33 so that the two ribs will be polarised to opposite magnetic polarity when electric current flows through the windings. The outer annular member has formed on its internal peripheral surface a pair of helical projections which extend into the grooves respectively. In the rest position the projections on the inner and outer members are separated from each other but when electric current flow occurs in the windings the projections on the members move towards each other to reduce the reluctance of the magnetic circuit. In so doing the end closure member 21 or output member moves to an extended position. During such movement the link initially contacts the end of the valve and is momentarily arrested. The relative movement of the annular members forming the device continues and the two spring washers which constitute energy storing means, are compressed. When the output member has moved to its extended position no further movement occurs but the valve is moved to the open position at least in part by the energy stored by the two spring washers, it being appreciated that some movement of the valve may occur before the relative movement of the two members forming the electromagnetic device 18 has ceased.

It will be appreciated that considerable magnification of the movement of the output member is effected by the link, so that the movement of the valve 10 is appreciable. When the windings are de-energised then the link 17 together with the parts movable therewith are returned to the position in which they are shown in the diagram, by means of the valve spring 13.

The supply of electric current to the windings 32, 33 can be effected by any convenient switch means which supplies signals to the windings in timed relationship with the position of the rotary parts of the engine. In this manner the valve can be opened and closed at the appropriate time and this timing can be adjusted as required. In order to minimise the power dissipation in the windings it can be arranged that when the maximum relative movement of the members has occurred, the current flow through the windings can be reduced.

Figure 2:
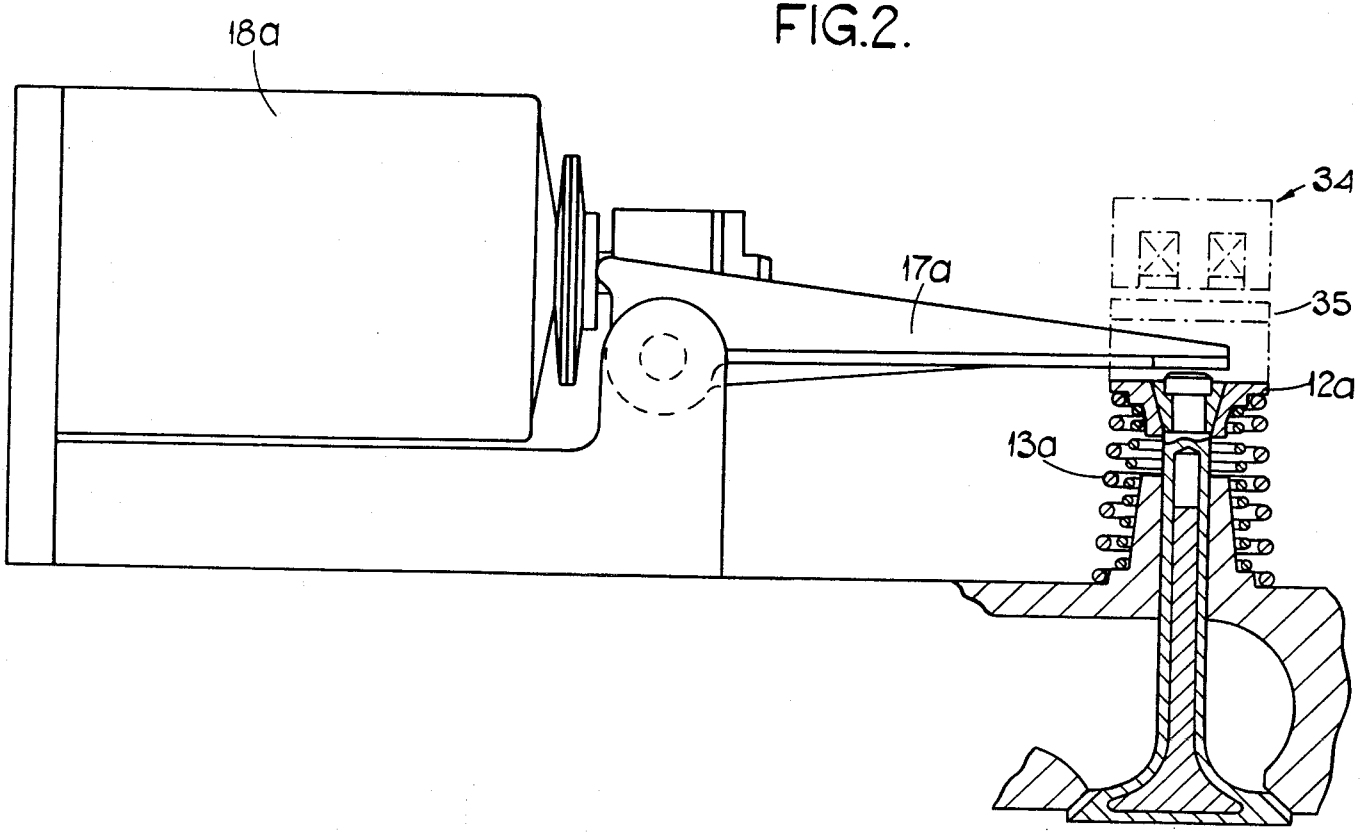
FIG. 2 illustrates a mechanism similar to FIG. 1 including a modified link and pivot arrangement.

The mechanism which is shown in FIG. 2 is basically the same as the one shown in FIG. 1. It will be noted however that the disposition of the link **17*a* relative to the electromagnetic device 18*a* is different. The mode of operation however is the same. It will be noted that in FIG. 2 the valve has a smaller stem thereby reducing its inertia. As a result the spring 13*a* loading the valve need not be so strong. As it happens a pair of springs are provided but in order to ensure that the valve will not be moved to the open position during the suction stroke of the engine a holding solenoid 34 is provided, this being shown in dotted outline. The solenoid 34 has associated therewith an armature 35 which conveniently is integrally formed with the spring abutment 12***a*. As shown a small gap exists between the armature 35 and the poles of the solenoid 34. The solenoid 34 is energised at least during the suction stroke of the engine and would be de-energised when the windings of the device 18*a* are supplied with electric current. It is envisaged that the solenoid 34 may be replaced by a permanent magnet. Again a gap would be provided between the armature 35 and the poles of the permanent magnet. In this case it will be appreciated that the electromagnetic device 18*a* must develop more power so that the force exerted by the permanent magnet can be overcome.

Figure 3:
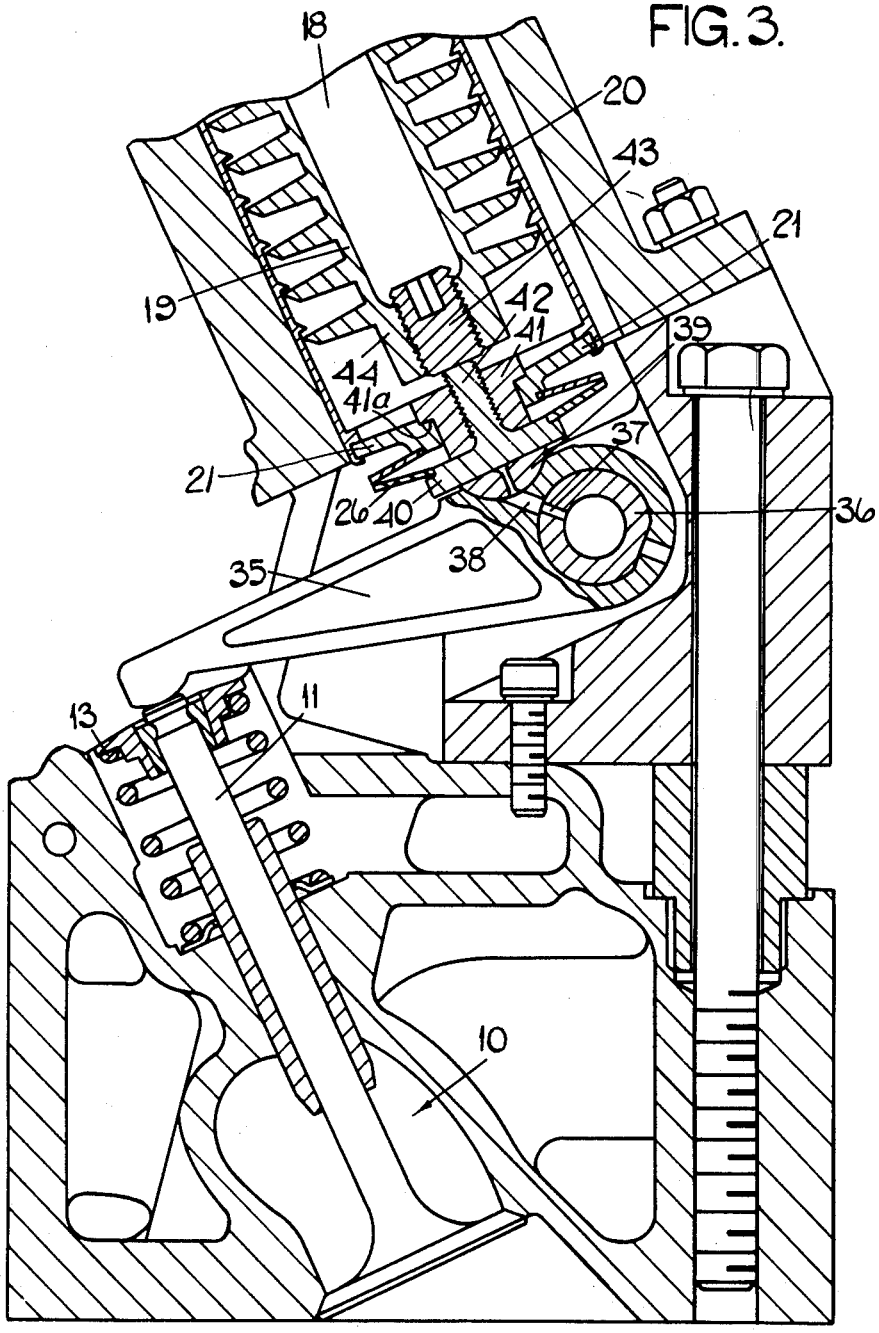
FIG. 3 illustrates a mechanism similar to FIG. 1 including a further modified link and pivot arrangement.

The arrangement shown in FIG. 3 is basically the same as the arrangement shown in FIG. 1 and identical reference numerals have been used wherever possible. The link 35 is mounted about a hollow pivot pin 36 which conveniently provides a pivot for all the links 35 of the engine. The interior of the pivot pin is in communication with the engine lubrication system. Moreover, in the wall of the pin at positions aligned with the links are drillings 37 which open to drillings 38 formed in the links respectively and communicating with spherical recesses formed in the links.

Each recess mounts a half spherical pressure member 39 in which is formed an axial drilling communicating with the drilling 38. For engagement with the flat surface of the member 39 there is provided a pressure pad 40 which locates the dished washer 26. Also provided is tubular guide 41 which is mounted for axial movement relative to the output member 21 and engagable therewith by means of a outwardly-extending flange 41*a*. The guide has a threaded bore in which is engaged a stop member 42 for engagement with an adjustable stop 43 mounted on an extension 44 of the inner annular member 19. The pressure member 39 provides for pivotal movement between the pressure pad 40 and the link 35.

The stop member 42 is integral with the pressure pad 40 and the tubular guide is provided with an outwardly extending flange which acts to limit the separation of the pressure pad 40 and the output member 21 under the action of the spring washers when the electromagnetic device is de-energised. The stop 43 acts to limit the return motion of the pressure pad when the electromagnetic device is de-energised it being appreciated that the stop will be adjusted so that in practice a small clearance will exist in the closed position of the valve, at some point in the connection between the outer member 20 and the stem of the valve.

The oil supply ensures that an oil film is established between the pad 40 and the pressure member 39 and in fact the clearance mentioned above will probably occur between these two components.

We claim:

1. An engine poppet valve operating mechanism comprising in combination, a pivotal link, said link being positioned in use, to engage a stem of the valve to be operated, an electromagnetic device having a winding to which electric current can be supplied when in use it is required to open the associated valve, an output member forming part of said device and which is moved to an extended position when said winding is energized, and energy storing means positioned between said output member and said link, said energy storing means comprising a pair of dished washers interposed between said output member and a further member cooperating with said output member and abutment means disposed between said link and said further member to permit pivotal movement therebetween, the arrangement being such that in use, when said winding is energized said output member will move to said extended position, the movement of the link and valve being at least partly effected by energy stored in said means during movement of said output member to the extended position.

2. A mechanism according to claim 1 in which said abutment means comprises a half spherical pressure member located against said further member said pressure member being located with a complementarily shaped recess in said link.

3. A mechanism according to claim 1 including means for limiting the relative movement of said output member and said further member under the action of the inherent resilience of said washers when the solenoid is de-energised.

4. An engine poppet valve operating mechanism comprising in combination, a pivotal link, said link being positioned in use, to engage a stem of the valve to be operated, an electromagnetic device having a winding to which electric current can be supplied so that when in use it is required to open the associated valve, an output member forming part of said device and which is moved to an extended position when said winding is energized, and energy storing means positioned between said output member and said link, said energy storing means comprising a pair of dished washers interposed between said output member and a further member cooperating with said output member and abutment means disposed between said link and said member to permit pivotal movement therebetween, the arrangement being such that in use, when said winding is energized said output member will move to said extended position, the movement of the link and valve being at least partly effected by energy stored in said means during movement of said output member to the extended position, and means for limiting the relative movement of said output member and said further member under the action of the inherent resilience of said washers when the solenoid is de-energized, said means comprising a tubular guide located in an aperture in said output member and having a flange engaging the surface of said output member remote from said washer, said tubular member being retained relative to said further member.

* * * * *